United States Patent [19]

Nute, Jr. et al.

[11] 4,015,811

[45] Apr. 5, 1977

[54] SUPPORT FOR A VAULTED CEILING MODULE - II

[75] Inventors: Ernest B. Nute, Jr., Mountville; Kenneth L. Wasson, Lancaster, both of Pa.

[73] Assignee: Armstrong Cork Company, Lancaster, Pa.

[22] Filed: Dec. 29, 1975

[21] Appl. No.: 644,649

[52] U.S. Cl. ..... 248/343; 52/28

[51] Int. Cl.[2] ..... H05B 33/02; E04B 5/52

[58] Field of Search ..... 248/342, 343, 214; 52/28, 39; 240/9 R, 52.1, 52.12

[56] References Cited

UNITED STATES PATENTS

| | | | |
|---|---|---|---|
| 3,512,313 | 5/1970 | Harz | 52/28 |
| 3,711,052 | 1/1973 | Hoffman | 248/343 X |
| 3,748,460 | 7/1973 | Price | 240/9 R |
| 3,755,667 | 8/1973 | Price | 240/51.12 |
| 3,786,602 | 1/1974 | Wilkin | 52/28 |

*Primary Examiner*—J. Franklin Foss

[57] ABSTRACT

Suspended ceiling systems are formed from a series of modules which may have a vaulted design and a light fixture therein. These modules must be supported from the main runners or cross tees of a suspended ceiling system. The support structure herein is fastened at one end to the main runners or cross tees of the suspended ceiling system and carry on their other end the main horizontal support members for the light fixture and vaulted module. Means positively lock the support structure to the main runner or cross tee of the suspended ceiling system.

4 Claims, 4 Drawing Figures

SUPPORT FOR A VAULTED CEILING MODULE - II

CROSS-REFERENCE TO RELATED APPLICATION

This application is an improvement over U.S. Application Ser. No. 637,900, filed Dec. 5, 1975, in the name of Harold W. Nikolaus and Ernest B. Nute, Jr. and entitled "SUPPORT FOR A VAULTED CEILING MODULE".

BACKGROUND OF THE INVENTION

1. Field of the Invention

The invention herein is directed to a suspended ceiling system and, more particularly, to a support structure for a module in a suspended ceiling system.

2. Description of the Prior Art

U.S. Pat. No. 3,081,398 is directed to a support bracket 32 which rests upon a main runner member and supports a light fixture in position in a suspended ceiling system.

U.S. Pat. No. 3,797,789 is directed to a support bar 8 which is mounted on the main runner structure of a suspended ceiling system. The support bar will support the light fixture and ceiling elements in a suspended ceiling system.

U.S. Pat. No. 3,512,313 is directed to a further example of a support bar which is utilized to support light fixtures and ceiling boards in a vaulted-type suspended ceiling system.

Finally, U.S. Pat. No. 3,511,012 is directed to a conventional main runner grid system such as is commonly used in conventional suspended ceiling systems.

SUMMARY OF THE INVENTION

The invention is basically directed towards a support structure which rests on the top of the vertical web of the inverted "T" runner in a suspended ceiling system. A support bar for a module is then fastened to the support structure and the support bar supports the light fixture and ceiling boards of a vaulted module of the suspended ceiling system. The support structure herein is provided with a hooked portion at its lower end which slides over the top of the vertical web of the inverted "T" runner of the suspended ceiling system. Tabs by the hooked portion of the support structure fasten the support structure to the inverted "T" runner structure. Means are provided to further engage the vertical web of the inverted "T" runner to positively lock the support structure to the runner structure. The upper end of the support structure is provided with a means which will engage the support bar to hold it in position within the suspended ceiling system. Normally, two support structures will be utilized on two adjacent inverted "T" runner structures to hold a support bar in position. The support bar in turn will hold a light fixture and ceiling board structure in position in a vaulted module.

DESCRIPTION OF THE PREFERRED EMBODIMENT

Figure 1:
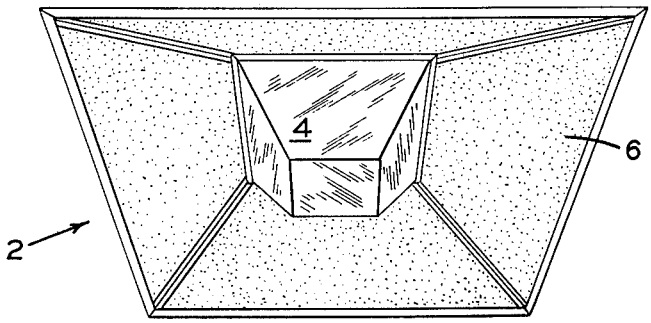
FIG. 1 is a perspective view of a vaulted ceiling module.

In FIG. 1 there is shown a conventional vaulted ceiling module. The module 2 contains a light fixture means 4 surrounded by four inclined ceiling boards 6 which provide the module with its vaulted or recessed configuration. A ceiling assembly could be composed of a plurality of modules 2, such as that shown in FIG. 1, placed in a side-by-side relationship, or the ceiling could be composed of a plurality of vaulted modules, such as that shown in FIG. 1, interspersed among a series of modules which contain simply flat boards and subsequently are not vaulted in configuration.

Figure 2:
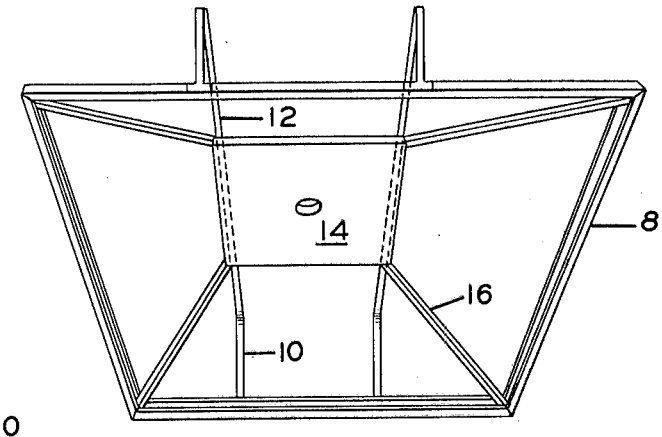
FIG. 2 is a perspective view of the supporting framework for a vaulted ceiling module.

Referring now to FIG. 2, there is shown the vaulted module with the ceiling boards and light fixture removed. The ceiling module is supported by a plurality of inverted "T" main or cross runner members 8, hereinafter called main runners, which form the suspension system for the overall ceiling system. A number of support structures 10, which constitute the inventive elements of this disclosure, are mounted upon the main runners 8. Normally, two support structures 10 would be placed on each of two adjacent parallel main runner members. A support bar 12 is then fastened to the top of each of the support structures 10 and the support bars 12 span the gap between two adjacent parallel main runner members. Normally, two support bars would be positioned within a square configuration main runner structure forming the outline for a conventional vaulted module. The base and light socket portion of the light fixture means will be mounted on the support bars 12. Actually, the light base 14 will be suspended from the support bars 12. From each of the four corners of the light base 14 to each of the four corners of the module where the main runner elements 8 join together, there will be positioned spacing strips 16 which will conceal the joints between adjacent ceiling boards. The ceiling boards 6 will be trapezoidal in shape, with the base of the trapezoid being in length equal to the length of a module side, and the width of the top of the trapezoid being equal to the width of a side of the light base 14. The main runner members will normally be suspended from the structural ceiling of a building by hanger wires such as is conventional in the art. The support structures 10 and support bars 12 will then support the light fixture in position in the center of a ceiling module, and the support structures 10 will be supported on the main runner members. The ceiling boards are then carried by the main runner members and the light fixture.

Figure 3:
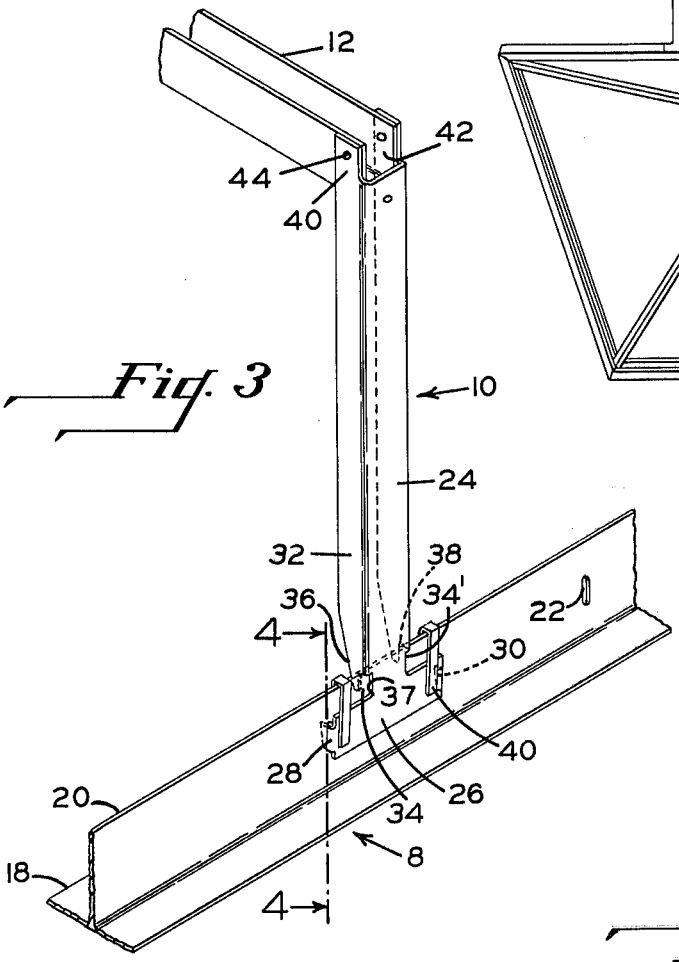
FIG. 3 is a perspective view of the support structure in operative position on a main runner structure.

Referring now to FIG. 3, there is a view of a single support structure 10 in position on a main runner member 8. Main runner 8, which is a conventional runner of inverted "T" shape, will be composed of a horizontal flange 18 and a vertical web 20. Within the vertical web, there will be placed a series of apertures 22 spaced at either 6 inch or 12 inch intervals along the web. U.S. Pat. No. 3,511,012 discloses a typical main runner structure such as that shown in FIG. 3 of this disclosure. The apertures 22 are used for the mounting of conventional cross runners. These apertures 22 are adapted for use within the structure herein to provide a point to fasten the support structure 10 to the vertical web 20 of the conventional main runner. The support 10 is composed of a body portion 24 which is generally formed from a U-shaped sheet metal channel. On the lower end of the body portion 24, there is positioned a plate 26 having two bent-out tabs 28 and 30. Also at the end of the body portion 24, on the sides 32 of the U-shaped configuration of the body portion 24, there is positioned cutouts 34 and 34'. The cutouts then form hook-like projections 36 and 38. The top of the vertical web 20 of the main runner structure is placed within the cutouts 34 and 34' and projections 36 and 38 will be positioned on one side of the vertical web of the main runner structure, while plate 26 will be on the opposite side of the vertical web of the main runner structure. The tabs 28 and 30 face towards the portion of the body portion 24 which has the cutout 34 and 34'. One of the tabs, in FIG. 3 being tab 28, is inserted into one of the apertures 22. The other tab 30 will not fit into an aperture since the plate 26 is only approximately 2 inches long and, therefore, the distance between two tabs in only 2 inches. As indicated above, the spacing between apertures 22 are either normally 6 or 12 inches. The tab 30, pressing against the side of the vertical web 20 of the main runner structure, then cocks or inclines the support structure 10 at a slight angle relative the vertical web of the main runner structure. This means that the vertical web 20 of the main runner structure, which passes through the cutout 34, will engage the back shoulder 37 of cutout 34 beside tab 28, but will engage the front shoulder 38 of cutout 34' beside tab 30. This tends to frictionally hold the support structure 10 in position on top of the vertical web 20 of the main runner structure. In addition, when tab 28 engages the aperture 22, the support structure 10 will be further held in position so that it will not slide longitudinally along the vertical web nor can it readily be lifted vertically from the vertical web 20. However, should the tab 28 slide out of engagement with aperture 22, this positive locking of the support structure 10 to the vertical web of a main runner structure can be destroyed.

Figure 4:
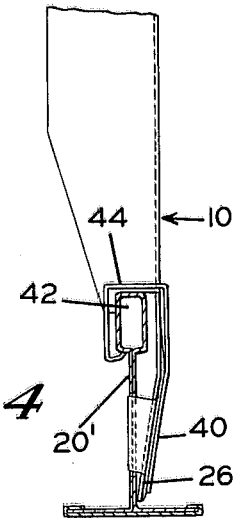
FIG. 4 is a cross-sectional view of a portion of FIG. 3.

In order to overcome this problem, a clip means is provided with a support structure 10 to more positively fasten the support structure 10 to the vertical web 20 of the main runner. Clips 40 may be positively fastened to plate 26 or may simply overlie plate 26. These clips then have hook elements which extend to the opposite side of the vertical web 20 to positively hold plate 26 in position against vertical web 20. Referring now to FIG. 4, there is shown a cross-sectional view of the structure above described. The vertical web 20' of FIG. 4 is a slightly modified version of the main runner structure of FIG. 3. Main runner structures are normally made from sheet metal and 20' shows a conventional main runner structure formed from sheet metal wherein the sheet metal is formed in such a manner that an enlarged area 42 is formed at the top of the vertical web 20'. Plate 26 is provided on one side of the vertical web 20'. A clip means 40 may either frictionally engage plate 26 or may be positively affixed to plate 26. The clip means 40 has a hook member 44 which passes over the top of the vertical web 20' and then down the opposite side of the vertical web 20' to positively hold the plate 26 in position on one side of the vertical web 20'. This in turn will keep tab 28 positively engaged with aperture 22. Damage of the plate 26 or accidental bending of the plate 26 or a forceful jarring action against support 10 may dislodge tab 28 from aperture 22 and thus destroy the fastening of the support structure 10 to the main runner due to the placing of tab 28 in aperture 22. The clip means 40 insures the positive engagement of tab 28 in aperture 22.

On the upper end of body portion 24, there is provided two tabs 40 and 42 which extend above body element 24. The tabs have apertures 44 therein. Another conventional U-shaped metal component, which constitutes support bar 12, is placed between the two tabs 40 and 42 and bolts or other fastening means will be passed through apertures 44 and through corresponding apertures in the ends of support bar 12 to fasten together support bar 12 and support structure 10. Support bar 12 would then be held in a horizontal position generally parallel to the plane of the horizontal members of the main runner structure.

The above structure is an improvement over the above-mentioned copending patent application and U.S. Pat. Nos. 3,081,398 and 3,797,789 in that it provides for a positive locking of the support structure 10 to the vertical web of the main runner structure without the use of fastening means such as screws. The positive locking is carried out without making any modifications to the vertical web of commercially available main runner structures, but by the use of a selective configuration to the bottom of the support structure 10, such that it can now positively engage certain structural elements normally existing in commercially available main runner structures and be held positively thereto.

What is claimed is:

1. In a support structure for supporting ceiling elements within a suspended ceiling system, the suspended ceiling system having main runner structures which are generally of an inverted "T" shape with an upwardly extending vertical web, said support structure having a body portion and at the lower end thereof, there being a cutout which will permit a portion of the body portion to be positioned on one side of the vertical web of a main runner structure and another portion of the body portion to be positioned on the other side of the vertical web of the main runner structure, at least one side of the body portion which is positioned on one side of the main runner structure having a plate structure, said plate structure extending generally parallel with the vertical web of the main runner and said plate structure having on the ends thereof a plurality of vertical tabs, said vertical web of the main runner structure having a plurality of vertical apertures positioned therein and only one of the tabs of the plate structure of the support structure being positioned in one of the apertures of the vertical web, at least one tab engaging the vertical web side, the upper end of the body portion having means to fasten the support structure to support bars which in turn will be positioned above and parallel to the plane of the main runner structures, the improvement comprising a clip means affixed to the plate structure and engaging the vertical web of the main runner structure to positively hold the plate structure in position against the vertical web of the main runner structure.

2. The support structure as set forth in claim 1 wherein said body portion is a U-shaped structure having at its lower end cut-outs in each side of the U-shaped cross section, said vertical web engages said cutouts to position a portion of the body portion on each side of the vertical web, said plate structure being fastened to a portion of the body portion on one side of said vertical web, said plate structure plane being inclined relative to the plane of the vertical web due to the positioning of one tab engaging an aperture in the vertical web and another tab pressing against the vertical web side.

3. The support structure as set forth in claim 1 wherein said clip means is an integral part of or is fixedly attached to the plate structure.

4. The support structure as set forth in claim 3 wherein said clip means has a body portion fixedly positioned on the plate structure and a hook portion which extends across the top of the vertical web of the main runner structure and then down the opposite side of the vertical web of the main runner structure to positively hold the plate structure adjacent one side of the vertical web of the main runner structure so as to positively retain a tab of the plate structure in one of the apertures of the vertical web.

* * * * *